United States Patent [19]

Lee et al.

[11] Patent Number: 4,750,205

[45] Date of Patent: Jun. 7, 1988

[54] FREQUENCY OR TIME DOMAIN SPEECH SCRAMBLING TECHNIQUE AND SYSTEM WHICH DOES NOT REQUIRE ANY FRAME SYNCHRONIZATION

[76] Inventors: Lin-Shan Lee, 3rd Fl., No. 79, Wen-Chou St., Taipei, Taiwan; Ger-Chih Chou, No. 10-1, Ping-Lang Rd., Hsing-Tien City, Taiwan; Ching-Sung Chang, No. 47-1, Lane 79, Ching-An Rd., Chung-Ho City, Taipei Hsien, Taiwan

[21] Appl. No.: 829,325

[22] Filed: Feb. 14, 1986

Related U.S. Application Data

[62] Division of Ser. No. 376,607, May 10, 1982, Pat. No. 4,591,673.

[51] Int. Cl.[4] ..... H04K 1/00

[52] U.S. Cl. ..... 380/9; 380/36; 380/38; 380/48

[58] Field of Search ..... 179/1.5 R, 1.5 S; 178/22.1, 22.17; 380/9, 36, 38, 48; 375/89; 370/86

[56] References Cited

U.S. PATENT DOCUMENTS

| | | | |
|---|---|---|---|
| 4,221,931 | 9/1980 | Seiler | 179/1.5 S |
| 4,232,194 | 11/1980 | Adams | 179/1.5 R |
| 4,379,205 | 4/1983 | Wyner | 179/1.5 R |
| 4,393,276 | 7/1983 | Steele | 179/1.5 R |
| 4,429,405 | 1/1984 | Bux et al. | 375/89 |
| 4,433,211 | 2/1984 | McCalmont et al. | 179/1.5 S |
| 4,443,660 | 4/1984 | DeLong | 179/1.5 R |
| 4,482,999 | 11/1984 | Janson et al. | 370/86 |
| 4,525,844 | 6/1985 | Scheuermann | 179/1.5 S |
| 4,551,586 | 11/1985 | Cox et al. | 179/1.5 S |
| 4,591,673 | 5/1986 | Lee et al. | 179/1.5 R |

*Primary Examiner*—Salvatore Cangialosi

*Attorney, Agent, or Firm*—Kirschstein, Kirschstein, Ottinger & Israel

[57] ABSTRACT

The present invention relates to speech scrambling techniques and systems and in particular to a frequency or time domain speech scrambling technique and system which does not require any frame synchronization. This invention is technique and system for scrambling speech signal in frequency or time domain by means of speech analysis-synthesis techniques. The system described above is very attractive because it has avoided the frame synchronization problem. The existing analog telephone channel can be utilized directly for transmission because bandwidth expansion is completely controllable. In addition, the "key space" is very large and a high degree of security can be achieved.

17 Claims, 6 Drawing Sheets

FREQUENCY OR TIME DOMAIN SPEECH SCRAMBLING TECHNIQUE AND SYSTEM WHICH DOES NOT REQUIRE ANY FRAME SYNCHRONIZATION

This is a division of application Ser. No. 376,607, filed May 10, 1982, now U.S. Pat. No. 4,591,673.

BACKGROUND OF THE INVENTION

The present invention relates to speech scrambling techniques and systems and in particular to a frequency or time domain speech scrambling technique and system which does not require any frame synchronization.

Communication security has become one of the major attractive problems in signal transmission and is getting more and more massive and complicated due to the rapid progress in communication developments.

At present the newest technique of secure speech communications is the use of a scrambled digital signal by the sender to transmit digits to receiver who in turn descrambles digital signal in conformity with sender's scrambling and transform them into an analog signal. However, this means of communication includes the following disadvantages:

1. Apparently, the sender and receiver require very accurate synchronization. This process not only makes implemention difficult and cost higher, but also is subject to transmission interruptions under poor channel conditions.

2. The current cost of setting up digital transmission facility is high.

The purpose of this invention is to provide improvements in transmission techniques subject to the above technical disadvantages, so that the synchronization problems can be solved (synchronization is not required) and a speech scrambling method offering a high degree of security is introduced. However, the means of signal communications adopted in this invention is still the conventional linear mode of transmission, i.e., analog transmission.

SUMMARY OF THE INVENTION

The primary processing method in this invention to transform speech signal waveform is to cut into numerous segments. The following is a full description of the method to process speech signal segments by the sender (transmitter) and receiver, respectively.

1. Processing for the Transmitter (1) Transform the selected speech signal segment into N digital signal samples using an A/D converter.

(2) Process several segments of the above digital signal samples to form a vector using a predetermined procedure.

(3) To scramble the speech process, the vector described above in (2) in the order perform a: Fast Fourier Transform (FFT), W on the vector multiply by a cryptograph matrix M of $N \times N$ and perform an Inverse Fast Fourier Transform (IFFT) denoted by performing $W^{-1}$; or directly scramble by a linear combination of "multiple uniform permutation" T.

(4) Re-process the scrambled vector described in (3) above according to the reverse procedure stated in (2) above.

(5) Transform the foregoing digital signal in (4) into analog signal through D/A converter, and then transmit the analog signal to receiver.

2. Processing Steps of the Receiver (1) Transform each of the received speech signal segments into digital signal samples using a A/D converter (same process as in para. 1 (1))

(2) Process several segments of the above N digital signal samples to form a vector according to the same procedure stated in para. 1 (2) above.

(3) To descramble process the vector described in (2) above in the order: perform an FFT W, multiply by cryptograph matrix $M^{-1}$ of $N \times N$ which is the inverse of M and perform an inverse FFT $W^{-1}$; or directly descramble by performing an inverse linear combination of "multiple uniform permutation" $T^{-1}$. (This step is just the inverse way of para. 1(3))

(4) Re-process the vector stated in (3) above according to the reverse procedure of the one described in 1 (2) above.

(5) Transform the foregoing digital signal in (4) into the speech signal segment originally transmitted and selected using a D/A converter.

In view of the foregoing it is apparent that every step taken to process speech signal by both the sender and receiver is mutually complementary (inverse).

The specific structure of this invention is formed in compliance with foregoing principles. The primary method is based on microprocessor techniques and will be stated in detail during describing an exemplary embodiment.

BRIEF DESCRIPTION OF THE DRAWINGS

Preferred exemplary embodiments of present invention are described in the following detailed description taken in connection with the accompanying drawing wherein.

DETAILED DESCRIPTION OF THE PREFERRED EXEMPLARY EMBODIMENT

Figure 1:
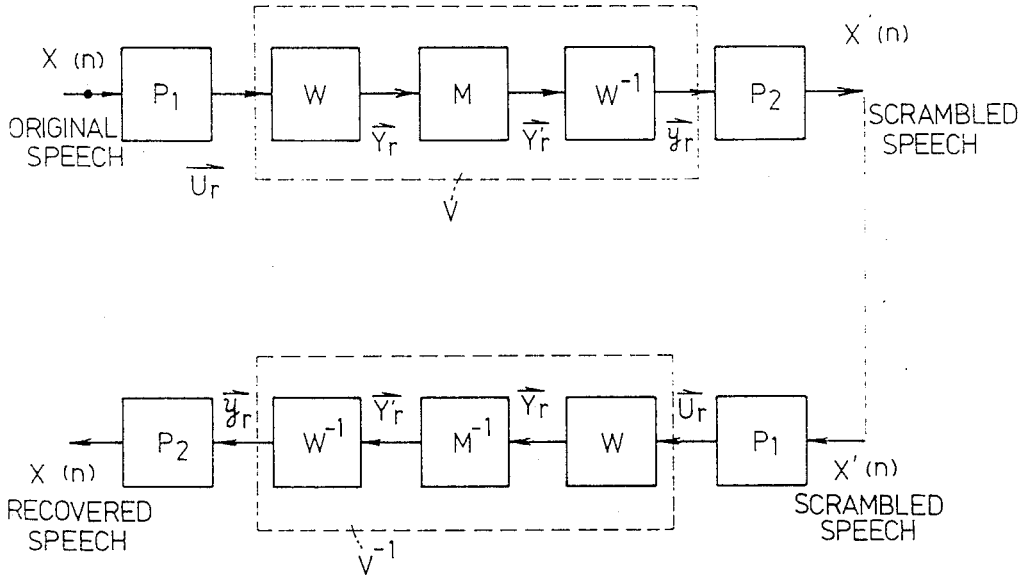
FIG. 1 is a block schematic flowchart of a first embodiment of speech scrambling and descrambling processes in accordance with the present invention.
Figure 2:
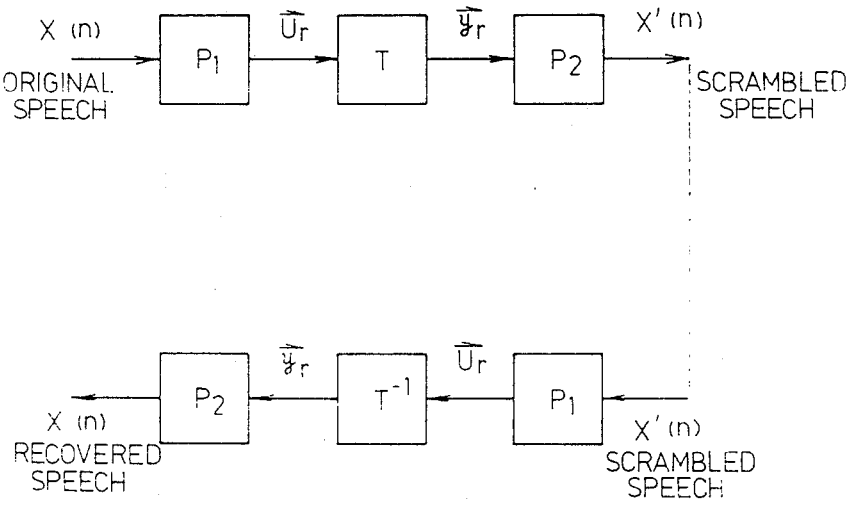
FIG. 2 is a block schematic flowchart of a second embodiment of speech scrambling and descrambling processes in accordance with the present invention.
Figure 3:
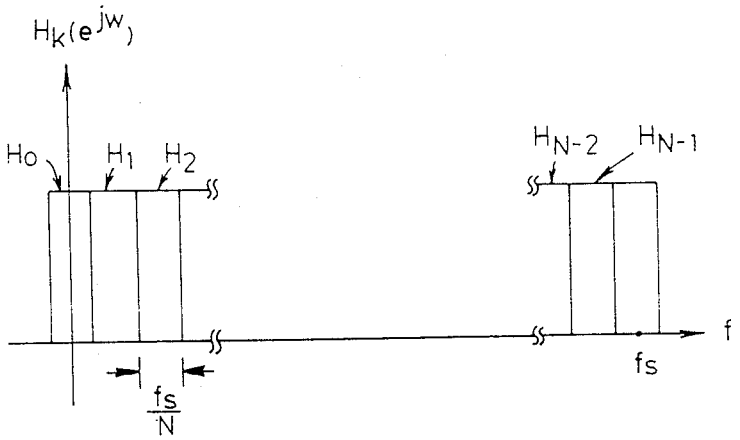
FIG. 3 is a diagram showing N ideal filters in a filter bank in accordance with the present invention.
Figure 4:
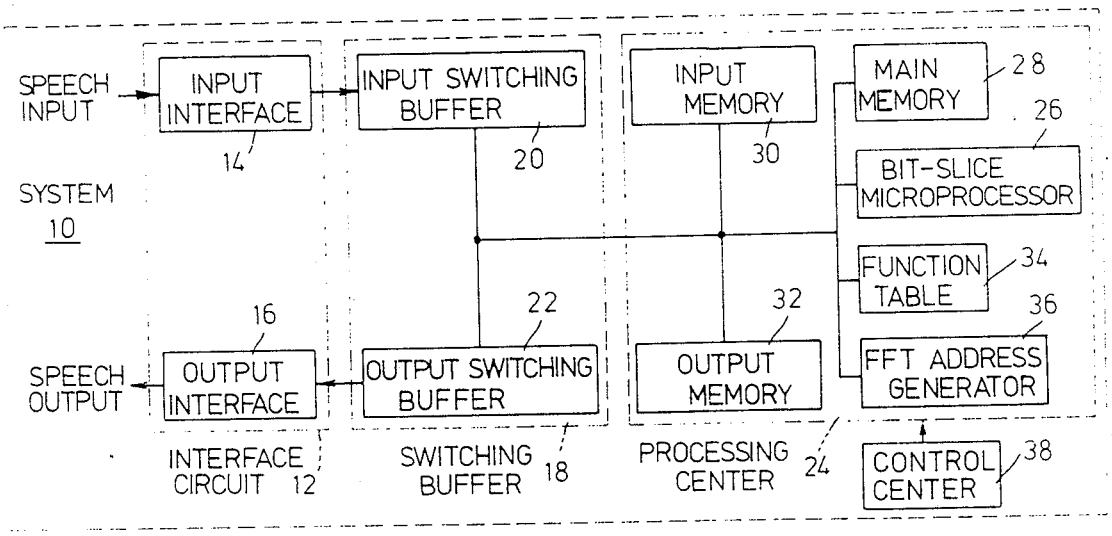
FIG. 4 is a block schematic diagram of hardware in accordance with the present invention.
Figure 11:
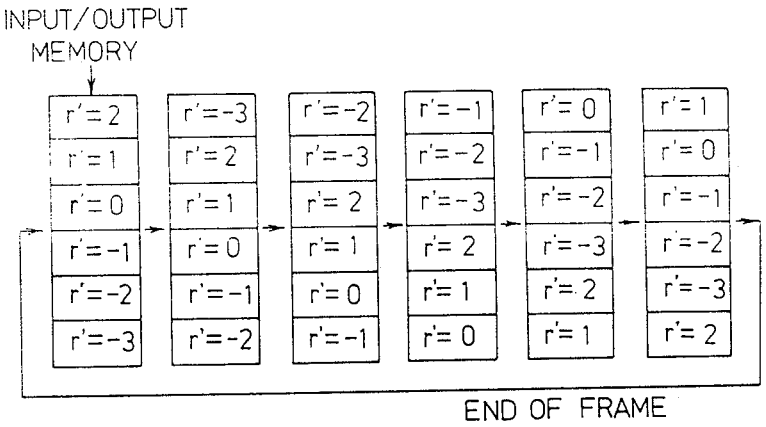
FIG. 11 is a diagram showing the flowchart of the address and time segments in the input memory of FIG. 4.

The basis of the present invention is shown in FIGS. 1 and 2 flowcharts of scrambling and descrambling processes. In fact, FIG. 2 is another form of FIG. 1. FIG. 3 is the N ideal filters in the filter bank, and FIG. 4 11 are the exemplary embodiment of the invention presented in this description. The detailed description is made in four parts below.

1. Theory Outline

We have discussed in the paragraph of "Summary of the Invention" the basic theory of the invention; FIGS. 1 and 2 indicate its essential structure. Block $P_1$ represents the operations explained in paragraph 1, sections 1(1) (2), and sections 2(1) (2). Block $P_2$ represents the functions as stated in sections 1(4) (5) or 2(4) (5). Therefore, $P_1$ and $P_2$ are indeed two blocks with inverse operation to each other. In addition, the Block V and $V^{-1}$ the dot-line blocks are also represent invert operations of each other corresponding to section 1(3) and 2(3). Further description is made as follows 1-1. Frequency and Time Domain Scrambling and Descrambling Operations Referring now to FIG. 1, x(n); n=0, 1, 2, . . . are the samples of the original speech signal. The vector $U_r$ is obtained after operation $P_1$ is performed on x(n), where $P_1$ and $P_2$ operations will be described later, and $$\vec{U}_r = [U_{eR}(10),\ U_{rR}(1), \ldots\ U_{rR}(N-1)] \quad (1)$$

$$r = 0, 1, 2$$

here $\vec{U}_r$ is an N-component vector, whose components, $R_{rR}(q)$, q=0, 1, . . . N−1, are time domain samples of the speech signal but rearraned and processed by the predetermined procedure of $P_1$ as described later. R is an integer, R N, representing the period at which the vector $U_r$ is obtained, i.e., a new vector $U_r$ will be obtained after every additional R speech samples x (n) is processed by $P_1$. This will be clearer after the operation of $P_1$ is described. The block W in FIG. 1 converts the vector $U_r$ by FFT, into another vector $\vec{Y}_r$, i.e., $$[Y_{rR}(k), k=0, 1, \ldots N-1 = \text{DFT } U_{rR}(q), q-0, 1 \ldots N-1 \quad (2)$$

$$Y_r = [Y_{rR}(o), Y_{rR}(1) \ldots Y_{rR}(N-1)]^T \quad (3)$$

where the "DFT" represents the function of Discrete Fourier Transform. For a more complete description of the DFT function, reference is made to Alan V. Oppenheim et al, "Digital Signal Processing", Prentice-Hall, Inc., Chapter 3. The N components, $Y_{rR}(K)$, K=0, 1 . . . N−1 of the new vector $\vec{Y}_r$ in fact represent the samples of the "short-time frequency spectrum" of the original speech signal X(n) at time n=rR. For a more complete description of the "short-time Spectral Analysis and Synthesis and Modification by Discrete Fourier Transform", see IEEE Transactions on Acoustics, Speech and Signal Processing, Vol. ASSP-25, No. 3, June 1977, pp. 235–238. In other words, $\vec{Y}_{rR}(K)$ represents the frequency component of the original Speech Signal in the $K^{th}$ frequency bank at time $n=rR$. Using vector notationss, let W be the N×N matrix for DFT, then $$\vec{Y}_r = W\vec{U}_r \quad (4)$$

i.e., the "DFT" function can be represented by a matrix multiplication, and, as described later, can be realized and implemented using microprocessors and Fast Fourier Transform (FFT) algorithms. Multiplying $\vec{Y}_r$ by an N×N cryptograph matrix M, i.e., $$\vec{Y}_r' = M\vec{Y}_r \quad (5)$$

and then taking Inverse Discrete Transform ($W^{-1}$ in-vector notation and using Inverse Fast Fourier Transform algorithm for realization), one obtains $$Y_r = W^{-1}\vec{Y}_r' = W^1MW\vec{U}_r = V\vec{U}_r \quad (6)$$

$$\text{where } V = W^{-1}MW \quad (7)$$

represents the combined effect of Discrete Fourier Transform, the Cryptograph matrix M, and the Inverse Discrete Fourier Transform, as indicated in FIG. 1. Thus, the input vector $\vec{U}_r$ is processed into the scrambled output vector $\vec{Y}_r$, i.e., Cryptograph Scrambling M is added into the frequency domain vectors $\vec{Y}_r$ to change it into $\vec{Y}_r$. After passing through the block $P_2$2, the vector $\vec{Y}_r$ is converted back into an analog signal. The scrambled speech X'(n) is ready to be transmitted. At the receiver, again assume the input speech after passing through $P_1$ is converted into digital form $U_r$. Repeating the above process but changing the cryptograph matrix M into its inverse, $M^{-1}$, one obtains $$\vec{Y}_r = W^{-1}M^{-1}W\vec{U}_r V^{-1}\vec{U}_r \quad (8)$$

It has been proven theoretically that, as long as the Blocks $P_1$ and $P_2$ are processed according to the method described hereafter, the synchronization is not required to descrambling. This is frequency domain scrambling technique.

Another method to scramble and descramble in time domain is shown in FIG. 2, the Blocks $P_1$ and $P_2$ are the same as shown in FIG. 1, while Block T represents is multiplying the rector $\vec{U}_r$ by a linear combination of Uniform Permutation, i.e.

$$T = \sum_{l=0}^{N-1} a_i B_{K1}, i \quad (9)$$

$B_{K1}$, is the uniform permutation of order $K_1$ and class i, defined as $$B_{K1}, i = [b_{rs}]r,s = 0,1, \ldots N-1 \quad (10)$$

$$b_{rs} = \begin{cases} 1,s = ((K_1 r + i))N \\ 0,s \neq ((K_1 r + i))N \end{cases}$$

where $((t))_N$ represents T modulo N, and $K_1$ is an integer prime to N thus, their relation is $$\vec{Y}_r = T\vec{U}_r \quad (11)$$

$$\vec{Y}_r = T^{-1}\vec{U}_r \quad (12)$$

for scrambing and descrambling, respectively.

It can be theoretically proved that if the matrix T is selected as a "linear combination of uniform permutation" as stated above the inverse "$T^{-1}$" used to descramble is also a "linear combination of uniform permutation". Such a system does not require synchronization to descramble, i.e., the original speech can be correctly recovered by the receiver without synchronization. This is because what is actually does is to perform the above frequency domain scrambling process (which do not require frame synchronization) without having to go into the frequency domain. This time domain scrambling method is even easier to realize and implement practically than the frequency domain method described earlier.

1-2. Theory of Filter Bank Speech Analysis and Synthesis

An ideal filter bank is shown in FIG. 3 as series of N of ideal bandpass filters with equal bankwidth in the spectrum. After being passed through this filter bank, the frequency components of the speech signal will be detected. This set of frequency components can be processed by the foregoing method of scrambling and descrambling and then an output speech waveform can be obtained by interpolating. As in FIG. 3, suppose x(n) are the input speech sample values, the frequency components detected by the filter on band No. K and time n, $Y_n(K)$ is $$Y_n(K) = \sum_{m=-\infty}^{\infty} X(m)\, h(n-m)\, e^{-j(\frac{2\pi}{N}K)m} \quad (13)$$

$$0 \leqq K \leqq N-1$$

in eq(13), h(n) is the low-pass equivalent impulse response of the filter, n is the time index.

If the important parts from eq (13), are divided into 21 sections and summed, one has:

where [t] means the greatest integer less than t. One has $$Y_n(K) = \sum_{q=0}^{N-1} U_n((q-7))_N e^{-j(\frac{2\pi}{N}K)q} \quad (14)$$

$$0 \leqq K \leqq N-1$$

where $$U_n(q) = \sum_{r'=-L}^{L-1} X(n+Nr'+q)h(-Nr'-q) \quad (15)$$

$$0 \leqq q \leqq N-1$$

and $((t))_N$ represents modulo-N value of t, and also eq(14) may be expressed as $$\{Y_n(K), K=0, 1, \ldots N-1\} = \mathrm{DFT}\ U_n(((q-n))_N, q=0, 1, \ldots N-1 \quad (16)$$

This equation is in fact eq(2) in the foregoing paragraph except in eq (2) n=rR and $U_n(q)$ should be modified into $U_n((q-n))_N$, i.e., in eq (2) $U_{rR}((q-rR)_N$ is represented $U_{rR}(q)$ for simplicity of presentation, and the computations of egs (15) (16) should be performed every R samples, or only when n−rR in the present invention; $Y_n(K)$ here is the frequency components in speech signal and caln be scrambled by use of egs (5), (6) above.

What we have discussed above is simply the method to complete speech analysis of ideal filter bank by means of FFT. Its synthesis method is described as follows:

Let $Y_{rR}(K)$ ($R \leqq N$) be a set of frequency components taken from $Y_n(K)$ at the period of every R samples, i.e., n=rR. According to interpolation theory, the complete sequence $Y_n(K)$ can be obtained by $$Y_n(K) = \sum_{r=L^-}^{L^+} Y_{rR}(K) f(n-rR) \quad (17)$$

in eq (17), f(n) is the interpolating filter impulse response.

$$L^+ = [n/R+L,\ L^- [= n/R] - L + 1$$

where [t] means the greatest integer less than t. But the speech waveform X(N) is related to the frequency components $$Y_n(K) \text{ by } X(n) = \frac{1}{N}\sum_{K=0}^{N-1} Y_n(K)\, e^{j(\frac{2\pi}{N}K)n} \quad (18)$$

substituting eq (17) in eq (18), one has $$X(n) \simeq \sum_{r'=L^-}^{L^+} f(n-rR)\left(\left(\frac{1}{N}\sum_{K=0}^{N-1} Y_{rR}(K)\, e^{j(\frac{2\pi}{N}K)((n))_N}\right.\right. \quad (19)$$

$$= \sum_{r'=L}^{L^+} f(n-r'R\, y_{r'R}((n))_N;$$

where $$\{Y_{rR}(n), n=0, 1, \ldots N-1\} = \mathrm{IDFT}\{Y_{rR}(K), K=0, 1, \ldots N-1\} \quad (20)$$

where "IDFT" represents the function of Inverse Discrete Fourier Transform, as used above in eq (6).

This is the method to complete speech synthesis by means of inverse FFT. For a more detailed explanation for the speech analyis and synthesis, reference is made to R. L. Rabiner and R. W. Schafter, "Digital Processing of Speech Signals 1.3 Summary From the theory, as long as the sets of frequency components $Y_{rR}(K)$, K=0, 1, . . . N−1, r=0, 1, 2, 3, . . . can be obtained with R N, the original time domain signal, X(n), can be recovered. Therefore, when the transmitter and receiver are not synchronized but perform the foregoing process once for every R sample period with R N, the original signal, (X(n) can always ve recovered. This is the reason why the synchronization is completely unnecessary. The complete operation of the frequency domain scrambling technique is summarized in the following. Egs (14) (15) may be expressed with n=rR, $$Y_{rR}(K) = \sum_{q=0}^{N-1} U_{rR}((q-rR))_N\, e^{-j(\frac{2\pi}{N}K)q} \quad (21)$$

$$0 \leqq K \leqq N-1$$

$$U_{rR}(q) = \sum_{r'=-L}^{L-1} X(rR+Nr'+q)h(-Nr'-q) \quad (22)$$

$$0 \leqq q \leqq N-1$$

where r is an integer because of one set of frequency components are obtained for every R samples; Since the procedure for scrambling and descrambling is the same as stated in 1-1, it may be expressed, except for descrambling M is replaced by M−1

$$\vec{Y}_r W \vec{U}_r \quad (4)$$

$$\vec{Y}' = MY_r \quad (5)$$

where $$\vec{Y}_r = [\hat{Y}_{rR}(K), K=0, 1, \ldots N-1]^T \quad (3)$$

$$\vec{U}_{rR} = [\hat{U}_{uR}((q-rR))_N, q=0, 1, \ldots N-1]^T \quad (23)$$

$$\hat{Y}_r = [\hat{Y}_{rR}(K), K=0, 1, \ldots, N-1]^T \quad (24)$$

Note that the definition of $\hat{U}_r$ in eq (23) is slightly different from that in eq (1). In FIG. 1, $P_1$, represents the operation of egs (22) (23), indicating the procedure to convert X(n) to $\hat{U}_r'$ while $P_2$ represents the operation of eq (19), indicating the procedure to convert $\hat{y}_r$ to X'(n). The blocks W, M, $W^{-1}$ represent the operations in egs (4), (5), (6), respectively. This describes the frequency domain scrambling technique of this invention. For the time domain scrambling technique in the invention as shown in FIG. 2, the operations of $P_1$, $P_2$ are exactly the same, while the operations of T, $T^{-1}$ are simply multiplying the input vector $\hat{U}_r$ by the matrices T and $T^{-1}$ as defined in egs (9–12).

2. System Design Considerations

Since the purpose is to accomplish real time operation, the simultaneous capabilities of all parts in the system, and the system processing speed become the essential considerations for system design.

2-1 Simultaneous Processing Capability

Figure 5:
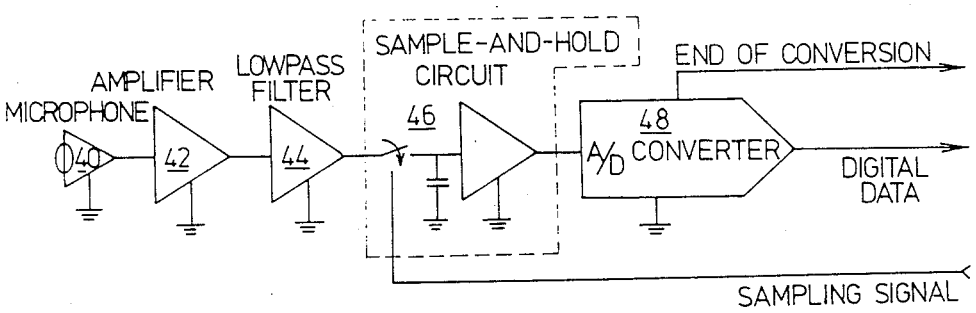
FIG. 5 is a diagram showing the input interface circuit of FIG. 4.
Figure 6:
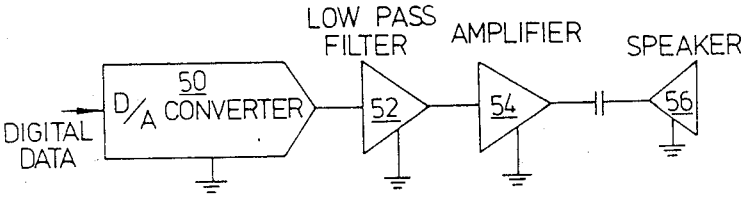
FIG. 6 is a diagram showing the output interface circuit of FIG. 4.

The complete system 10 is shown in FIG. 4 for the frequency jomain scrambling system. It can be divided into four main parts (A) Interface Circuit 12: It processes filtering and sampling of the analog signal, and conversions between the analog signal and digital data. This circuit is divided into input and output interfaces 14 and 16 respectively. As shown in FIG. 5, input interface 14 consists of an amplifier 42 stage, low-pass filter 44, sample-and hold circuit 46 and analog-to-digital converter 48 (A/D converter). As shown in FIG. 6, output interface 16 comprises a the digital-to-analog (D/A) 50, 20 low-pass filter 52 and amplifier 54 stage.

(B) Switching Buffer 18: The switching buffer 18 is divided into input buffer 20 and output buffer 22. Input buffer 20 receives the data from interface circuit 12 and provides the digital data required in proceessing center 24. Output buffer 22 receives the processed digital data from processing center 24 and simultaneously provides the output data for output interface 16.

(C) Processing Center 24: The processing center 24 consists of a bit-slice micro-processor 26, main memory 28, 30 input memory 30 output memory 32, function table 34, and FFT address generator 36. Processing Center 24 is capable of performing the calculations of all the data, scrambling and descrambling, and is responsible for control of data exchange in switching buffer 18.

(D) Control Center 38: The control center 38 is a small microprocessor system mainly composed of a Z-80 CPU. It is responsible for input of cryptograph, generating a cryptograph matrix and control of the interrupt and execution of processing center 24.

The interface circuit 12 and switching buffer 18 are able to process their own incoming and outgoing data by themselves and free from the control of the processing center 24. The processing center 24 performs data calculation independently at normal time and is free from restriction of the control center 38.

2-2. Interconnection (A) The interface circuit 12 and switching buffer 18 are able to inform each other of the data transferred between them.

(B) The data transferred between the switching buffer 18 and processing center 24 are controlled by the latter.

(C) The processing center 24 works independently and freely but may be interrupted in operation by the control 15 center 38 at any time when a cryptograph matrix is required to be put in. This interrupt effects loading the cryptograph matrix into the main memory 28.

2-3. Speed of Process

In the described system, the period of clock pulse 20 is 250 ns, while the sampling speed is 8 $KH_z$. Assume every frame has 256 samples, i.e., N=256, the system has to complete the processing for one frame of data in 32 msec. In eqs (19) (22), taking L=3, then, the data processed in every frame are related to the samples of preceding 5 frames in which data have been stored. The actions of the system to process data includes four kinds of operations:

(A) Data Transfer: The system transfers data between switching buffer 18 and processing center 24.

(B) Data Multiplication: The system performs data 30 multiplication by function value and summation.

(C) FFT and inverse FFT (D) Scrambling and descrambling

According to actual operation, the system's actions are of the following 4 types with total numbers to be completed 35 in 32 msec:

(A) Data transfer among memory units: about 4,000 times (B) Data transfer between memory and central processing unit 26: about 20,000 times (C) Addition: about 15,000 times (D) Multiplication: about 11,000 times If a general microprocessor is used as the central processing unit, it is doubtful whether the aove complicated functions can be performed. Therefore, a bit-slice microprocessor is adopted and supplemented with a multiplier 90 in order to increase the operation speed.

3. Hardware Structure 3-1. Interface Circuit 12

(A) Input Interface 14: Referring now to FIG. 5, the original signal coming from a microphone 40 passes through a 2-stage amplifier 42, and a signal 2 volts peak-to-peak amplitude is obtained. This signal is then filtered by a butterworth low-pass filter 44 of order 10 of which the cutoff frequency of 3 $KH_z$ and an amplitude response which decreases rapidly to −35 dB at 4 $KH_z$. After filtering, this signal is converted into digital data. Samples are taken from the sample-and-hold circuit 46 at the sampling rate of 8 $KH_z$ and processed by A/D converter 48. Then, the A/D converter 48 will generate a EOC (End of Conversion) signal to initiate data transfer into the input buffer. This circuit is shown in FIG. 5.

(B) Output Interface 16:

The structure of output interface is simplier than that of input interface. Referring now to FIG. 6, the output interface consists of a D/A converter 50, a low-pass filter 52 of order 6 and an output amplifier 54 to drive a speaker 56.

3.2 Switching Buffer 18

Figure 7:
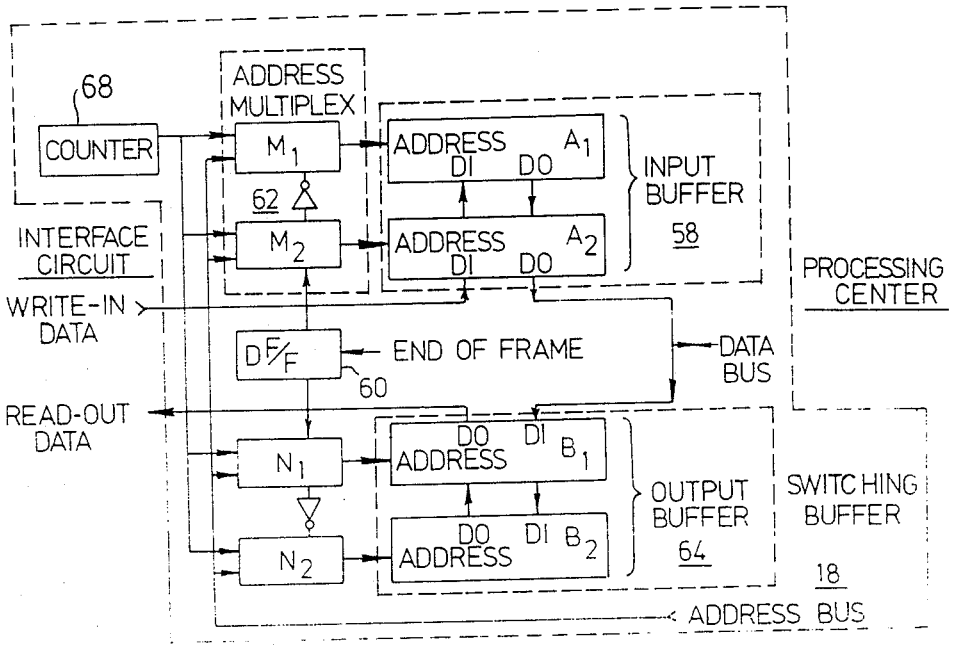
FIG. 7 is a diagram showing the switching buffer of FIG. 4.

(A) Input Buffer 20: As shown in FIG. 7, the input buffer 20 consists of 2 sets of 256×12 bits memory $A_1$ and $A_2$, in which data write-in and read-out are controlled by a D-type flip-flop 60 of one shift per frame. When $A_1$ is used as the data write-in buffer of the interface circuit, $A_2$ will be used as the data read-out buffer of the processing center are to represent $M_1$ and $M_2$ are multiplexers 62 controlled by D-type flip-flop 60. The multiplexer-$M_1$ selectively applies a content of the counter 63 as the address of $A_1$ (or $A_2$) and the multiplexer-$M_2$ connects the address bus of the processing center to $A_2$ or ($A_1$). Once the interface circuit data is written, the counter 63 will be incremented by 1. When $A_1$ is filled up the D-type flip-flop will reverse its value to make $A_1$ and $A_2$ exchange their functions. Such operations repeat and continue.

(B) Output Buffer 22: The structure of output buffer 22 is similar to that of input buffer and is also controlled by D-type flip-flop 60 and counter 63. However, different from input buffer, the output buffer reads data from processing center 24 and writes data into output interface circuit 16.

Figure 8:
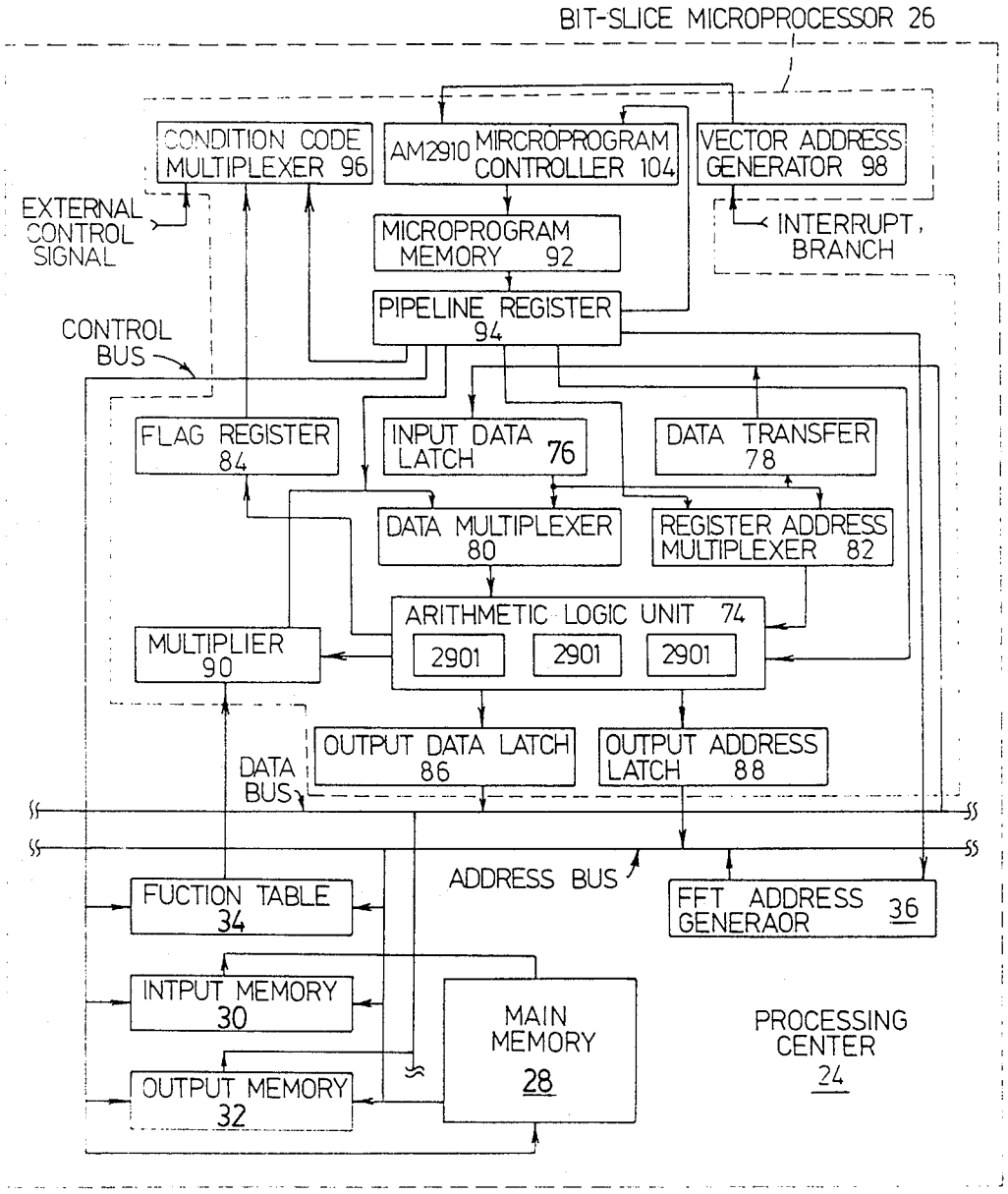
FIG. 8 is a block schematic diagram showing the processing center of FIG. 4.

3-3. Processing Center: As shown in FIG. 8, the processing center 24 is composed an arithmetic logic unit 74 including three data processors 104 (AM2910), a microprogram controller AM2910, a high-speed multiplier 90 (TRW-12HJ), main memory 28, input and output memory 30 and 32 and logic gates. Combining these components, the processing center forms a bit-slice microprocessor system having the following characteristics:

(A) Instructions are controlled by the microprogram so that any special instruction is easily obtained as needed.

(B) Only 1 sec is needed to transfer data between different memory units.

(C) 12 bits data by 12 bits data fixed point multiplication takes only 250 sec.

(D) Capacity for processing interrupt and branch sinals is provided

As shown in FIG. 8 the processing center has 3 data processors AM2910 in series to form an arithmetic logic unit (ALU)74 with 4×3=12 bits data length. Arithmetic logic unit 74 cooperates with:

(A) Input data latch 76: To latch the input data (B) Data Transfer Gate 78: To control transfer of the data in the input latch 76.

(C) Data Multiplexer 80: To determine the data source required by AM2901.

(D) Register Address Multiplexer 82: To determine the source of register address used in AM2901.

(E) Flag Register 84: To hold and refresh the flag cnditions.

(F) Output Data Latch 86: To send the processed data to.

(G) Output Address Latch 88: To hold an external memory address.

(H) High-speed Multiplier 90: To execute the operation of multiplication and summation in CPU.

The processing center uses a microprogram controller (AM2910) to generate microprogram addresses in accordance with the system microprogram as well as modified by the external control signal and the flags of the arithmetic logic unit 74 cooperating with controller 104 are:

(A) Microprogram Memory 92: A total of 8 memory 256×8 TTL PROMs in series establishes the length of microinstruction at 64 bits. These 64-bit instructions contain enough information to control various conditions occurring in processing center 24.

(B) Pipeline Register 94: The pipeline register consists of eight 8-bit D-type flip-flops used to latch the data of microprogram memory. This register uses the system clock as trigger pulse to update contents.

(C) Condition code multiplexer 96: The condition code multiplexer is controlled by the microprogram. It selects external control signal or flags as reference inputs to microprogram controller.

(D) Vector address generator 98: This generator stores the address where the program is branched or interrupted and provides such address to the microprogram controller 104 when necessary.

The function table 34 is programmed into an EPROM, which consists of 2K×12 bits memory to provide special function values required for calculations by the arithmetic logic unit (such as h(n) in eq(22) in eq(19) and cos(s) sin(s) required in FFT). The function value read out by processing center will be sent to one of the input ports of the high-speed multiplier for multiplication by data applied to another port by arithmetic logic unit 74.

The FFT address generator 36 generates the required address is for FFT computation to increase the speed of the arithmetic logic unit 74.

The main memory 28 having 2K×12 bits in total, stores the cryptograph matrix and computation data.

The input/output memory 30, 32 stores the required 6 frames of data to be processed in every frame of time.

Figure 9:
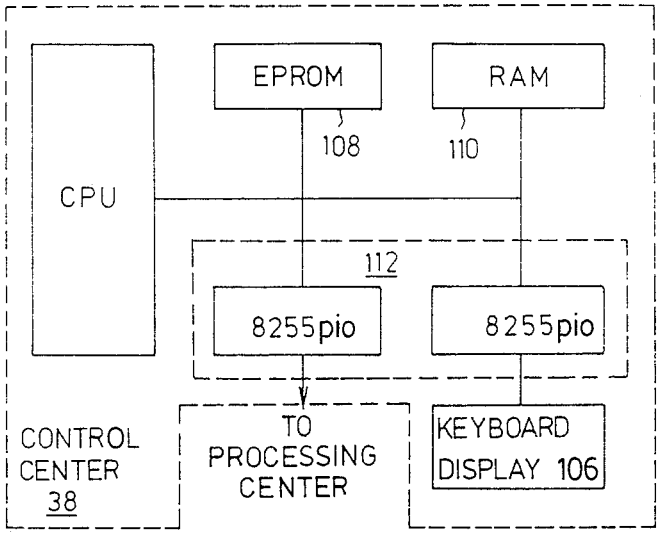
FIG. 9 is a block schematic diagram showing the control center of FIG. 4.

3-4. Control Center: Referring now to FIG. 9, the control center 38 comprises a Z-80 microprocessor system including (A) 1K byte monitor program stored in EPROM 108.

(B) 1K byte RAM 110 used by monitor program for storing at least one cryptograph matrix.

(C) Two 8255 PIO chips 112 for interfacing with keyboard display 106 and processing center 24.

4. Real Time Operation Procedure

As previously noted, the real time operating procedure of the complete system may be divided into the following five steps expressed mathematically.

$$\text{(A) } U_{rR}(q) \cong \sum_{r'=-L}^{L-1} X(rR + Nr' + q)h(-N' - q) \quad 0 \leqq q \leqq N-1 \tag{22}$$

$$\text{(B) } \{Y_{rR}(K), K = 0,1,\ldots N-1\} = DFT\{U_{rR}((q - rR))_N, q = 0,1,\ldots,N\}. \tag{23),(4}$$

$$\text{(C) } \vec{Y}_{r'} = M\vec{Y}_r \tag{5),(3}$$

$$\text{(D) } Y_{rR}(n), n = 0,1,\ldots,N-1 = IDFT\ Y_{rR}(K), K = 0,1\ldots,N-1. \tag{6),(24}$$

$$\text{(F) } X'(n) \cong \sum_{r'=L-}^{L+} f(n - r'R)\, y_{rR}((n))_N \tag{19}$$

In these five steps, we take R=N=256, L=3

Figure 10:
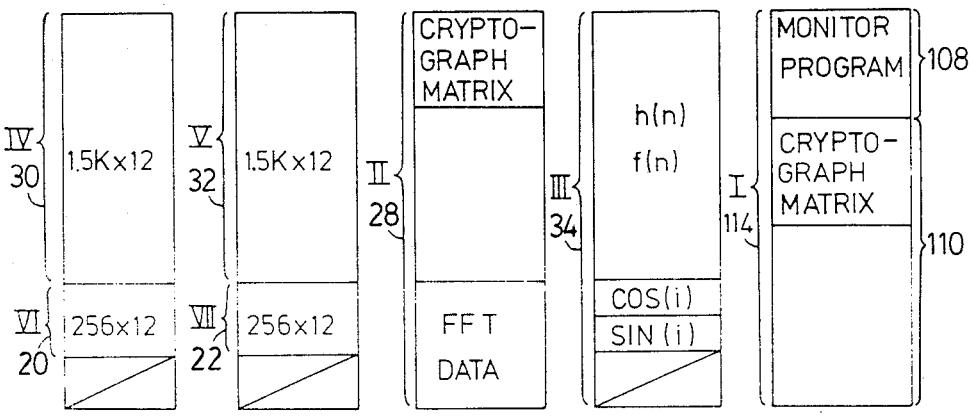
FIG. 10 is a block schematic diagram showing the system memory in accordance with the present invention.

The memory map of the complete system including a RAM 110 and an EPROM 108 is illustrated in FIG. 10, being divided into seven regions:

(I) Control center memory 108, 110

(II) Main memory 28

(III) Function table 34

(IV) Input memory 30

(V) Output memory 32

(VI) Input buffer 20

(VII) Output buffer 22

Operation of the steps relating to (A) (E) is described below:

Step (A):

$$U_{rR}(q) \cong \sum_{r'=-L}^{L-1} X(rR + Nr' + q)h(-Nr' - q) \quad (22)$$
$$0 \leqq q \leqq N - 1$$

One frame of the data from input buffer 20 are transferred into input memory 30. This frame of data, together with other five frames of data already stored in the input memory, i.e., a total of six frames of data, are multiplied by the function value $h(-Nr'+q)$ and summed to obtain $U_{rR}(q)$. A cyclic counter is set up here to automatically adjust the input memory's address permanently at $r'=-3$, whenever a new frame of data is going to be written in. In fact, the contents in memory are not moved, only the address r' is changed. In doing so, the preceding five frames $r'=-3, -2, -1, 0, 1$ will move forward one frame, and become $r'=-2, -1, 0, 1, 2$, while the original frame of $r'=-2$ disappears automatically. The status transition is demonstrated in FIG. 11.

Step (B):

$$\{Y_{rR}(K), K=0, 1, \ldots N-1\}=DFT\{U_{rR}((q-rR))_N, q=0, 1, \ldots, N-1\} \quad (23), (4)$$

Figure 12:
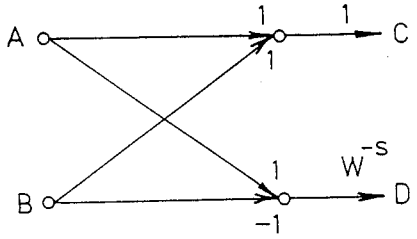
FIG. 12 is a diagram showing the relation between the input and output of butterfly structure in accordance with the present invention.

Because N=R, this simply corresponds to performing 256 decimation in frequency FFT on U- which includes eight passes, each having 128 butterfly structures (computation). The relation between the input and output data of each butterfly structure is shown in FIG. 12. Mathematically, $$C=A+B \quad (25)$$

$$D=(A-B)W^{-s} \quad (26)$$

if A, B, C, D, are all complex numbers, can be expressed as:

$$A=a+ja' \quad (27)$$

$$B=b+jb' \quad (28)$$

$$C=c+jc' \quad (29)$$

$$D=d+jd' \quad (30)$$

$$c=a+b \quad (31)$$

$$c'=a'+b' \quad (32)$$

$$d=(a-b)\cos(s)+(a'-b')\sin(s) \quad (33)$$
$$d'=(a'-b')\cos(s)-(a-b)(\sin(s) \quad (34)$$

In these eqs, a, b, c, d are the read parts stored in the main memory 68 addressed 600H 6FFH; a', b', c', d' are the imaginary 20 parts stored in the main memory 68 addressed 700H~7FFH; and cos (s), sin (s) are the function values stored in the function table 100 addressed 600H~6FFH.

During implementation of the butterfly structure the address of a set of input data (A,B) is the same as that of a 25 set of output data (C,D); while the addresses of the function value, input data and output data are produced by the FFT address generator 36.

Figure 13:
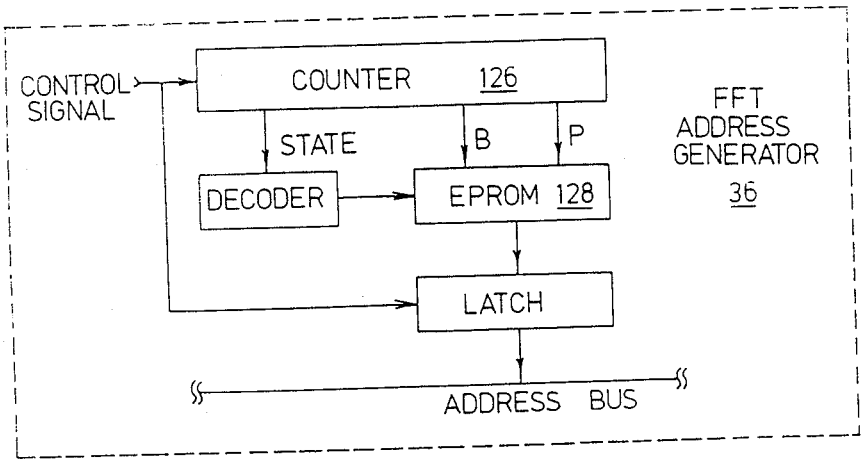
FIG. 13 is a block schematic diagram showing the structure of Fast Fourier Transform (FFT) address generator of FIG. 4.

The address generator 36 is composed of a series of counters 126 together with an EPROM 128 and logic gates (FIG. 13). Step (C):

$$\vec{Y}_r=M\vec{Y}_r \quad (5)\ (3)$$

Since $\hat{U}_{rR}$ is a real variable vector, the frequency component vector obtained, $\bar{Y}_{rR}'$ is conjugately symmetrical, i.e.

$$\vec{Y}_{rR}(K)=\vec{Y}_{rR}^*(N-K)K=0, 1, \ldots, N-1 \quad (35)$$

In order to preserve this symmetrical relation, during scrambling only N/2 samples can move freely while the other N/2 samples are changed accordingly. Hence if N=256, there will be at most 128! different scrambling matrices. This step is to permute $Y_{rR}$ into $Y_{rR}'$ according to the scrambling matrix M.

Step (D):

$$\{Y_{rR}(n)\ n=0, 1, \ldots, N-1\}=IDFT\{Y_{rR}(K), K=0, 1, \ldots N-1\} \quad (6), (24)$$

The operation of inverse FFT is the same as that of 5 FFT except that the relation between input and output data is changed. Therefore, $$\begin{cases} C = \frac{1}{2}(A + B) & (36) \\ D = \frac{1}{2}(A - B)\ W^{s} & (37) \end{cases}$$

$$\begin{cases} c = \frac{1}{2}(a + b) & (38) \\ C = \frac{1}{2}(a' + b') & (39) \\ d = \frac{1}{2}[(a - b)\cos(s) - (a' - b')\sin(s)] & (40) \\ d' = \frac{1}{2}[(a' - b')\cos(s) - (a - b')\sin(s)] & (41) \end{cases}$$

During computation the four terms c, c', d, d' have to shift right one bit (divided by two) and then be transferred back to main memory 28 to complete operation of the butterfly structure.

Step (E):

$$X'(n) \cong \sum_{r'=L-}^{L+} f(n - r'R)\, y_{rR}((n))_N \quad (19)$$

The $Y_{rR}(n)$ value is multiplied by the interpolating function and summed with the preceding five frames of data to get X'(n). X'(n) are then transferred into the output buffer 22.

Time required for each step is as follows:

Step (A) 4 msec

Step (B) 9 msec

Step (C) 2 msec

Step (D) 9 msec

Step (E) b 4 msec

Other 2 msec

A total of 30 msec is required for implementation. There is still about 2 msec additional margin compared with the usage maximum period of frame 32 msec.

Described above is the complete structure and operation of the frequency domain technique of this invention. For the time domain technique, the structure and operation is similar except everything has to do with FFT and inverse FFT is eliminated, and the scrambling matrix M is replaced by the "linear combination of uniform permutation" T described in eqs (9)-(12).

What is claimed is:

1. A method of scrambling a continuous audio signal for transmission by a sender, and descrambling a received scrambled signal at a receiver, comprising the steps of:

at the sender:

reading out at random one time frame of the continuous audio-frequency analog signal;

converting this analog signal into a serial digital signal;

forming, from said serial digital signal, successive digital vectors;

re-arranging, without frame synchronization, the order of said digital vectors in accordance with a predetermined procedure to form scrambled digital vectors; converting the scrambled digital vectors into a scrambled continuous audio frequency analog signal to be transmitted by the method of analog transmission;

at the receiver:

reading out at random one time frame of the scrambled continuous audio-frequency analog signal;

converting this analog signal into a serial digital signal;

forming, from said serial digital signal replicas of said scrambled digital vectors;

re-arranging, without frame synchronization, the order of elements in said replica of said scrambled digital vectors in accordance with the reverse procedure of the sender's predetermined procedure to form descrambled digital vectors;

converting said descrambled digital vectors into a recovered analog signal; and amplifying the recovered analog signal and converting it into sound waves.

2. The method of claim 1 wherein said sender rearranging step comprises:

forming frequency component vectors by performing a Fast Fourier Transform (FFT) on said digital vectors;

forming scrambled frequency vectors by multiplying said frequency component vectors by a predetermined cryptograph matrix; and forming said scrambled digital vectors by performing an inverse FFT on said scrambled frequency vectors.

3. The method of claim 2 wherein $\vec{U}_r$ is one frame of said digital vectors, W is an N×N FFT matrix, $W^{-1}$ is an inverse, FFT matrix, M is said cryptograph matrix, $\vec{Y}_r$ is said frequency component vectors, $\vec{Y}_r'$ is said scrambled frequency component vectors and $y_r$ is said scrambled digital vectors, and said forming scrambled frequency vectors ($Y_r'$) step is in accordance with $\vec{Y}_r' = M\vec{Y}_r$; and said forming said scrambled digital vectors ($y_r$) step is in accordance with $\vec{Y}_r - W^{-1}\vec{Y}_r' = W^{-1}MW\vec{U}_r$.

4. The method of claim 2 wherein said receiver rearranging step comprises the steps of:

forming replicas of said scrambled frequency component vectors by performing an FFT on the replica of said scrambled digital vectors;

forming replicas of said frequency component vector by multiplying said scrambled frequency vector replicas by the inverse of said cryptograph matrix;

said forming frequency component vectors ($Y_r$) step is in accordance with $Y_r = WU_r$;

forming said descrambled digital vectors by performing an inverse FFT on said frequency component vector replicas.

5. The method of claim 3 wherein said receiver rearranging step comprises the steps of:

forming replicas of said scrambled frequency component vectors by performing an FFT on the replicas of said scrambled digital vectors;

forming replicas of said frequency component vectors by multiplying said scrambled frequency vector replicas by the inverse of said cryptograph matrix; and forming said descrambled digital vectors by performing an inverse FFT on said frequency component vector replicas.

6. The method of claim 5 wherein $M^{-1}$ is the inverse matrix of the cryptograph matrix M and said forming replicas of said scrambled frequency component ($\vec{Y}_r$) vectors step is in accordance with $\vec{Y}_r = W\vec{U}_r$;

said forming replicas of said frequency component vector step is in accordance with $\vec{Y}_r' M^{-1}\vec{Y}_r$;

said forming said descrambled digital vectors step is in accordance with $Y_r = W^{-1}Y_r'$.

7. The method of claim 1 wherein said sender rearranging step comprises the step of multiplying said digital vectors by a linear combination of uniform permutation matrices.

8. The method of claim 7 wherein $\vec{U}_r$ is one N-component frame of said digital vector, $\vec{Y}_r$ is said scrambled digital vector, and T is said linear combination of uniform permutation matrices:

$$T = \sum_{i=0}^{N-1} a_i B_{k1}, i$$

where $B_{k1}$,i is the uniform permutation matrix of order $k_1$ and class i: $B_{k1}$, $i=[brs]r$, $s-0, 1, \ldots N-1$ $$b_{rs} = 1 \quad \text{when } S = ((K_1 r + i)) \text{ MODULO } N$$
$$\text{when } S \neq ((K_1 r + i)) \text{ MODULO } N$$

and $K_1$ is an integer prime to N; and said forming said scrambled digital vector steps is in accordance with $\vec{y} = TU_r$.

9. The method of claim 7 wherein said receiver rearranging step comprises the step of multiplying said replicas of said scrambled digital vectors by the inverse of said linear combination of uniform permutation matrices.

10. A method for communicating scrambled audio frequency signals with a scrambling transmitter and a descrambling receiver, comprising the steps of generating a serial digital signal corresponding to said audio analog signal in response to an audio frequency analog signal, generating successive digital vectors in response to said serial digital signal;

rearranging, without frame synchronization, the order of the elements of said digital vectors in accordance with a predetermined scrambling procedure to form scrambled digital vectors;

converting said scrambled digital vectors into a scrambled audio frequency analog signal; and transmitting said scrambled audio frequency analog signal.

11. The method of claim 10, further including the steps of:

receiving said transmitted scrambled audio frequency analog signal;

converting said scrambled analog signal into a serial digital signal;

forming replicas of said scrambled digital vectors from said serial digital signal;

rearranging, without frame synchronization, the order of elements in said replicas of said scrambled digital vectors in accordance with the inverse of said predetermined scrambling procedure to form descrambled digital vectors;

converting said descrambled digital vectors into a recovered analog signal; and converting said recovered analog signal into audible form.

12. The method of claim 10 wherein said rearranging step includes the step of multiplying said digital vectors by a linear combination of uniform permutation matrices.

13. The method of claim 11 wherein said step of rearranging said elements of said digital vectors includes the step of multiplying said digital vectors by a linear combination of uniform permutation matrices.

14. The method of claim 13 wherein said step of rearranging said replicas of said scrambled digital vectors include the step of multiplying said scrambled digital signal replicas by the inverse of said linear combination of uniform permutation matrices.

15. The method of claim 10 wherein said rearranging step includes the steps of:

performing a Fast Fourier Transform (FFT) on said digital vectors to form frequency component vectors;

multiplying said frequency component vectors by a predetermined cryptograph matrix to form scrambled frequency vectors; and performing an inverse FFT on said scrambled frequency vectors to form said scrambled digital vectors.

16. The method of claim 11 wherein said step of rearranging said replicas of said scrambled digital vectors includes the step of multiplying said scrambled digital signal replicas by the inverse of said linear combination of uniform permutation matrices.

17. The method of claim 15 wherein said step of rearranging said replicas of said scrambled digital vectors includes the steps of:

performing an FFT on said scrambled digital vectors to form replicas of said scrambled frequency vectors;

multiplying said scrambled frequency vector replicas by the said inverse cryptograph matrix to form replicas of said frequency component vectors; and performing an inverse FFT on said frequency component vector replicas to form said descrambled digital vectors.

* * * * *